US009693151B2

(12) United States Patent
Akino

(10) Patent No.: US 9,693,151 B2
(45) Date of Patent: Jun. 27, 2017

(54) CONDENSER MICROPHONE UNIT

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKIKAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 14/724,330

(22) Filed: May 28, 2015

(65) Prior Publication Data

US 2015/0358741 A1 Dec. 10, 2015

(30) Foreign Application Priority Data

Jun. 4, 2014 (JP) ..... 2014-115550

(51) Int. Cl.

| | |
|---|---|
| ***H04R 25/00*** | (2006.01) |
| ***H04R 19/04*** | (2006.01) |
| ***H04R 19/00*** | (2006.01) |
| ***H04R 1/38*** | (2006.01) |

(52) U.S. Cl.

CPC ..... *H04R 19/04* (2013.01); *H04R 1/38* (2013.01); *H04R 19/005* (2013.01)

(58) Field of Classification Search

CPC ..... H04R 19/04; H04R 19/005

USPC ..... 381/174

See application file for complete search history.

(56) References Cited

U.S. PATENT DOCUMENTS

| | | | | |
|---|---|---|---|---|
| 6,148,089 | A | 11/2000 | Akino | |
| 2004/0032957 | A1* | 2/2004 | Mansy | A61B 5/04085 381/67 |
| 2006/0285707 | A1* | 12/2006 | Izuchi | H04R 19/016 381/191 |
| 2009/0161885 | A1* | 6/2009 | Donaldson | G10K 11/1788 381/71.6 |
| 2012/0033844 | A1* | 2/2012 | Akino | H04R 1/02 381/356 |

* cited by examiner

*Primary Examiner* — Duc Nguyen
*Assistant Examiner* — Sean H Nguyen
(74) *Attorney, Agent, or Firm* — Manabu Kanesaka

(57) ABSTRACT

In a primary sound pressure-gradient type condenser microphone unit driving a diaphragm by difference in sound pressure applied to acoustic terminals in front and back of the diaphragm, a drive force of the diaphragm and sound collection characteristics in a high frequency band are easily adjusted. The condenser microphone unit includes a first pipe extending forward on the front side of a diaphragm and a second pipe arranged so as to surround the first pipe. A front acoustic terminal communicating with a front surface of the diaphragm is formed on an inner side of either one of the first pipe or the second pipe. A rear acoustic terminal communicating with a back surface of the diaphragm from the rear side of a fixed electrode is formed on an inner side of the other pipe.

15 Claims, 4 Drawing Sheets

CONDENSER MICROPHONE UNIT

RELATED APPLICATIONS

The present application is based on, and claims priority from, Japanese Application No. JP2014-115550 filed Jun. 4, 2014, the disclosure of which is hereby incorporated by reference herein in its entirety.

BACKGROUND OF THE INVENTION

Field of the Invention

The present invention relates to a condenser microphone unit, and especially relates to a primary sound pressure-gradient type condenser microphone unit which drives a diaphragm by difference in sound pressure applied to front and rear acoustic terminals.

Description of the Related Art

A primary sound pressure-gradient type condenser microphone including acoustic terminals in front and rear of a diaphragm drives the diaphragm by difference in sound pressure applied to the front and rear acoustic terminals. A force driving a diaphragm (hereinafter called a drive force) and an upper limit of a frequency which can obtain a sufficient drive force can be determined by a distance between acoustic terminals. Specifically, in the case where a distance between acoustic terminals is short, the drive force of a diaphragm is lowered although the diaphragm operates at a high frequency. On the other hand, it is the other way around if the distance between acoustic terminals is long.

As described above, a conventional primary sound pressure-gradient type microphone has mutually opposite characteristics regarding a drive force of a diaphragm and sound collection in a high frequency band. However, these characteristics are determined when a microphone unit is designed. Therefore, it has been difficult to adjust the characteristics after the unit has been formed.

To solve the above issue, a distance between the front and rear acoustic terminals needs to be changed on the outside of the primary sound pressure-gradient type microphone unit. Specifically, the distance between the front and rear acoustic terminals can be changed if a sound wave path such as an acoustic tube is provided between the front and back acoustic terminals, and the length of the sound wave path can be changed. As a result, a drive force of a diaphragm and sound collection characteristics in a high frequency band can be easily adjusted.

Also, a primary sound pressure-gradient type microphone is conventionally used as a directional microphone. Therefore, the primary sound pressure-gradient type microphone can preferably adjust directivity.

An applicant of the present invention proposes, in JP 3975007 B1, a structure in which a baffle 52 is attached around a diaphragm 51 of a unidirectional condenser microphone unit 50 as illustrated in FIG. 5, those are stored in a recess 55*a* formed to an outer frame 55 of a display panel for a computer, and sound wave goes around into the recess 55*a* from a space (side terminal) 54 outside of the baffle 52 is collected on a rear acoustic terminal 56 side.

However, in the structure disclosed in JP 3975007 B1, a distance between front and rear acoustic terminals is changed by a size (area) of a baffle, and therefore a diameter of the recess 55*a* on the outer frame of a panel (opening diameter) needs to be changed, and it significantly affects a design aspect.

For example, a structure as illustrated in FIG. 6 is considered to change the distance between front and rear acoustic terminals without changing a diameter of an opening for storing a unit. An acoustic tube 61 extending forward is provided on a front surface side of a microphone unit 60, and the distance is adjusted by the length of the acoustic tube 61. In the case of FIG. 6, an opening 70*a* is provided on a wall 70, and the microphone unit 60 is stored from the opening 70*a*.

However, in the case of such a structure, a path as illustrated in FIG. 6 needs to be secured. Specifically, a bottomed acoustic tube 63 is provided and the unit and the acoustic tube 61 are arranged therein. Also, a path through which sound wave goes into the unit rear side from the outside of a baffle plate 62 needs to be secured. Therefore, since a path of sound wave is doubly provided to the unit rear side, a wide space is needed on the rear side of the wall 70, and a structure becomes complicated.

SUMMARY OF THE INVENTION

The present invention is focused on the above-described issue, and aimed at providing a condenser microphone unit which can easily adjust a drive force of a diaphragm and sound collection characteristics in a high frequency band as a primary sound pressure-gradient type condenser microphone unit which can drives the diaphragm by difference in sound pressure applied to acoustic terminals in the front and back of the diaphragm.

To solve the above-described issue, a condenser microphone unit according to the present invention includes: a fixed electrode in which multiple sound holes are formed; and a diaphragm arranged with a predetermined space from the fixed electrode, the condenser microphone unit being a primary sound pressure-gradient type condenser microphone unit which drives the diaphragm by difference in sound pressure applied to front and back of the diaphragm, wherein the condenser microphone unit includes a first pipe arranged on a front side of the diaphragm and extending forward, and a second pipe arranged so as to surround the first pipe, a front acoustic terminal communicating with a front surface of the diaphragm is formed on an inner side of either one of the first pipe or the second pipe, and a rear acoustic terminal communicating with a back surface of the diaphragm from a rear side of the fixed electrode is formed on an inner side of the other pipe.

Preferably, an opening corresponding to a position of the first pipe is formed to each of the diaphragm and the fixed electrode, an insulating pipe including an insulating material is fitted to and inserted into the first pipe and the opening, and front and rear sides of the fixed electrode are acoustically separated, the rear acoustic terminal is formed on an inner side of the first pipe, and the front acoustic terminal is formed on an outer side of the first pipe and on an inner side of the second pipe.

By configuring as described above, a distance between a front acoustic terminal and a rear acoustic terminal (distance between terminals) is changed just by changing the length of the first pipe and the second pipe, and a drive force of a diaphragm and sound collection characteristics in a high frequency band can be easily adjusted.

Also, the above-described adjustment can be performed within the range of the diameter of a unit, and therefore a space for the rear acoustic terminal and other member are not needed around the unit, and a microphone can be simply assembled in a saved space.

Alternatively, the first pipe extending toward a front of the diaphragm may communicate with a front surface of the diaphragm, and the front acoustic terminal may be formed in an inner side of the first pipe. And diameters of the fixed electrode and the diaphragm may be formed smaller than a diameter of the second pipe, and the rear acoustic terminal which becomes a communication path to a rear side of the fixed electrode may be formed on an outer side of the first pipe and an inner side of the second pipe.

By configuring as described above, an effect similar to the above-described effect can be obtained.

In a primary sound pressure-gradient type condenser microphone unit which can drive the diaphragm by difference in sound pressure applied to acoustic terminals in the front and back of the diaphragm, a condenser microphone unit can be obtained in which a drive force of a diaphragm and sound collection characteristics in a high frequency band can be easily adjusted.

DESCRIPTION OF THE PREFERRED EMBODIMENTS

Figure 1:
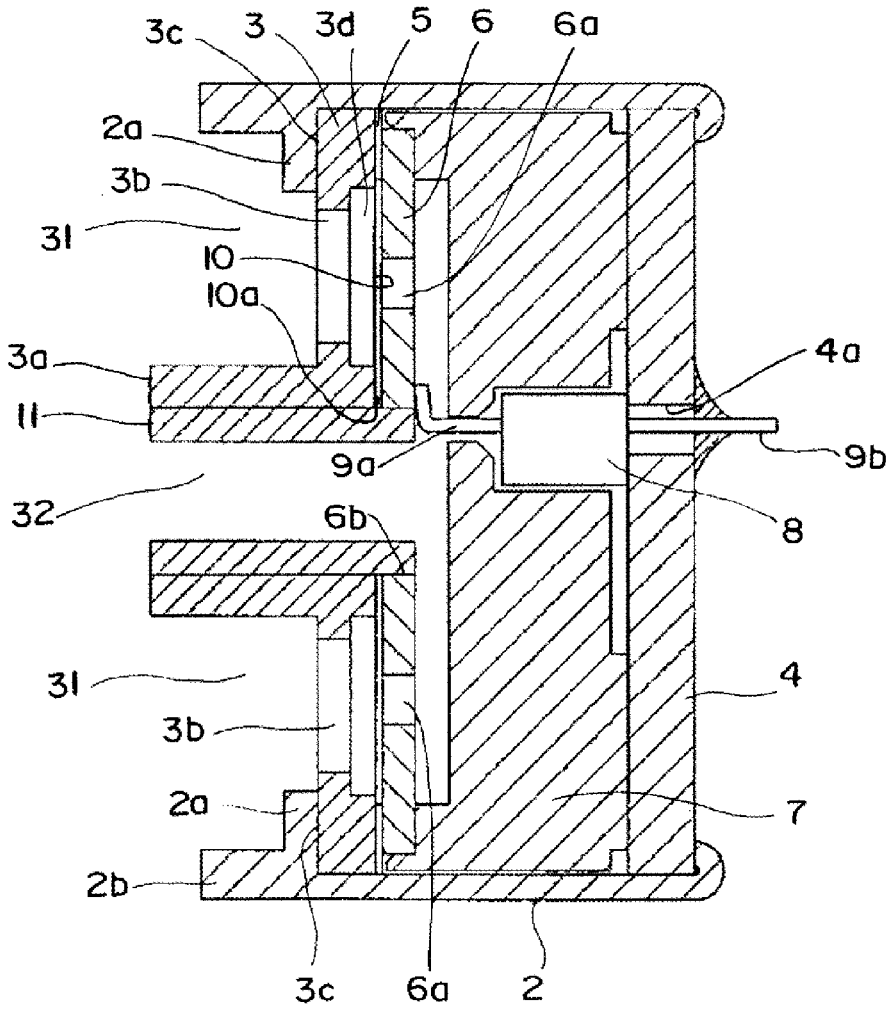
FIG. 1 is a cross-sectional view of a condenser microphone unit according to the present invention.

An embodiment of the present invention will be described below with reference to drawings. FIG. 1 is a cross-sectional view of a condenser microphone unit according to the present invention.

A condenser microphone unit 1 illustrated in FIG. 1 includes a cylindrical housing 2 in which longitudinal both ends (the left side in FIG. 1 is the front side, and the right side in FIG. 1 is the rear side) are opened, a front lid 3 arranged on a front opening side of the housing 2, and a rear lid 4 arranged on a rear opening side of the housing 2.

A pipe 3*a* (first pipe) having a predetermined diameter and cylindrically extending in an axial direction is formed at a center of the front lid 3. Multiple sound holes 3*b* are provided at a lid around the pipe 3*a*. A peripheral end of the front lid 3 comes into contact with an inner peripheral surface of the housing 2. The housing 2 further protrudes forward from the position, and a large diameter pipe 2*b* (second pipe) is formed.

Accordingly, a sound wave path communicating with the sound hole 3*b* is formed on an outer side of the pipe 3*a* and an inner side of the pipe 2*b*, and the sound wave path becomes a front acoustic terminal 31.

A flange 2*a* protruding on the inner side is provided on the front side inner peripheral surface of the housing 2, and a peripheral end 3*c* of the front lid 3 is locked on an inner side of the flange 2*a*.

A recess 3*d* widely and annularly formed around the pipe 3*a* is formed on a rear surface side (back surface side) of the front lid 3, and the annular recess 3*d* communicates with the sound hole 3*b* on a front surface side of the front lid 3. A film-like diaphragm 10 is attached on the rear surface side of the front lid 3 so as to close the annular recess 3*d*. An opening 10*a* having a diameter same as the inner diameter of the pipe 3*a* is formed at a center of the diaphragm 10.

A ring-shaped spacer 5 is arranged at a peripheral end on a rear side of the diaphragm 10. Also, a disk-shaped fixed electrode 6 including multiple sound holes 6*a* is arranged on a rear side of the spacer 5. Specifically, the diaphragm 10 and the fixed electrode 6 are arranged at intervals by the height of the spacer 5. At a center of the fixed electrode 6, an opening 6*b* is formed corresponding to a position and an inner diameter of the pipe 3*a* as with the diaphragm 10.

A peripheral end of the fixed electrode 6 is held by a holding plate 7 including an insulating material having a thickness. A predetermined space is formed between the fixed electrode 6 and the holding plate 7. Inner diameters of the pipe 3*a* longitudinally doubled at a center of a unit, the opening 10*a* of the diaphragm 10 and the opening 6*b* of the fixed electrode 6 are formed in the same size. An insulating pipe 11 formed of an insulating material is fitted to and inserted into the inner diameter. Therefore, a front side and a rear side of the fixed electrode 6 are acoustically separated.

By the configuration described above, sound wave entered from the insulating pipe 11 in the pipe 3*a* goes around to a rear side of the fixed electrode 6 and applies sound pressure to a rear side of the diaphragm 10 through the sound hole 6*a* of the fixed electrode 6. Specifically, the pipe 3*a* and the insulating pipe 11 function as a rear acoustic terminal 32.

Also, according to such a configuration, the distance between the front acoustic terminal 31 and the rear acoustic terminal 32 can be changed by changing each length of the pipe 2*b* and the pipe 3*a*. Therefore, a drive force of the diaphragm 10 and sound collection characteristics in a high frequency band can be simply adjusted in accordance with usage conditions.

In the holding plate 7, for example, an FET8, which is an impedance converter, is arranged. A signal line 9*a* is connected to the FET8. The signal line 9*a* is drawn out to the fixed electrode 6 side and further connected to the fixed electrode 6. The signal line 9*b* is drawn out to a rear side of a microphone unit through the opening 4*a* formed in the rear lid 4 from the FET8.

As illustrated in the drawing, the rear lid 4 is arranged on a back surface side of the holding plate 7. The rear lid 4 is fixed by swaging the periphery of a rear surface thereof to an inner side of a rear end opening of the housing 2.

Figure 2:
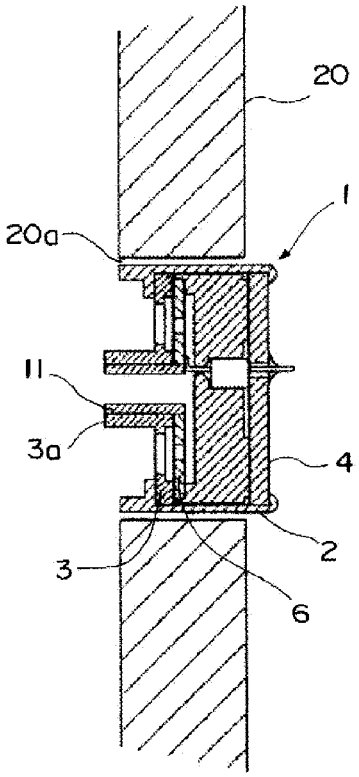
FIG. 2 is a cross-sectional view illustrating an application example of the condenser microphone unit according to the present invention.

In the case where the condenser microphone unit 1 configured as above is, for example, incorporated in a casing wall of a computer, an opening 20*a* fitting to a diameter of the housing 2 may be formed to a wall 20 as illustrated in FIG. 2, and the condenser microphone unit 1 may be fitted thereto.

Figure 5:
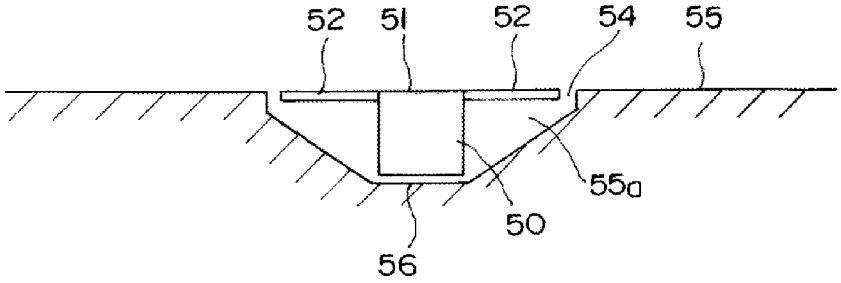
Fig. 5 Prior Art
FIG. 5 is a cross-sectional view illustrating an application example of a conventional condenser microphone unit.
Figure 6:
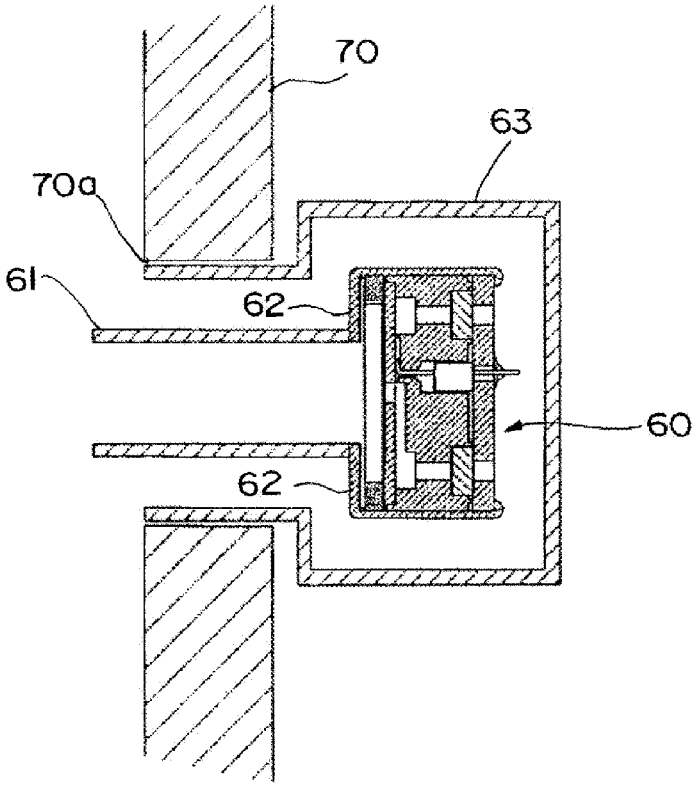
Fig. 6 Prior Art
FIG. 6 is a cross-sectional view illustrating another application example of the conventional condenser microphone unit.

In this manner, a space and other member around a unit as in a conventional configuration illustrated in FIG. 5 are not needed, and therefore saving space and simple configuration can be realized.

Figure 3:
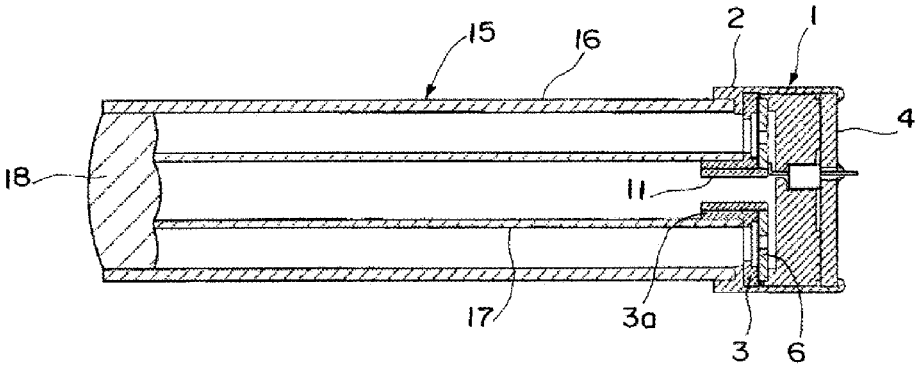
FIG. 3 is a cross-sectional view illustrating another application example of the condenser microphone unit according to the present invention.

Also, according to the condenser microphone unit 1, a close-talking type microphone can be configured by connecting a coaxial acoustic tube 15 on the front side thereof as illustrated in FIG. 3. The coaxial acoustic tube 15 has a double structure by an outer acoustic tube 16 and an inner acoustic tube 17. Also, in this example, an acoustic resistance material 18 is provided at an end of the microphone. As illustrated in FIG. 3, a rear end of the inner acoustic tube 17 is fitted to a peripheral surface of the pipe 3*a*, and a rear end of the outer acoustic tube 16 is inserted into a front side inner peripheral surface of the housing 2. Accordingly, since a distance between a front acoustic terminal and a rear acoustic terminal becomes long, a drive force of a diaphragm is increased although sound collection characteristics in a high frequency band is lowered, and a close-talking microphone can be easily realized.

As described above, according to an embodiment of the condenser microphone unit according to the present invention, the pipe 3*a* having a small diameter and communicating with a rear side of the diaphragm 10 is provided on a front surface side of the unit, and the pipe 2*b* having a large diameter and communicating with a front side of the diaphragm 10 is provided so as to surround the pipe 3*a*.

Specifically, a pipe is doubly provided on a front surface side of the unit. The rear acoustic terminal 32 is formed on an inner side of the pipe 3*a* having a small diameter. The front acoustic terminal 31 is formed on an outer side of the pipe 3*a* having a small diameter and on an inner side of the pipe 2*b* having a large diameter.

Therefore, a distance between the front acoustic terminal 31 and the rear acoustic terminal 32 is changed just by changing the length of the pipe 3*a* and the pipe 2*b*, and a drive force of the diaphragm 10 and sound collection characteristics in a high frequency band can be easily adjusted.

Also, the above-described adjustment can be performed within the range of the diameter of a unit, and therefore a space for the rear acoustic terminal 32 and other member are not needed around the unit, and simple assembly becomes possible while saving space.

Furthermore, the outer acoustic tube 16 and the inner acoustic tube 17 illustrated in FIG. 3 may be replaceable. For example, in FIG. 3, the outer acoustic tube 16 can be easily changed by forming screw threads on an outer side of the outer acoustic tube 16 and an inner side of the housing 2 fitting thereto. In the same manner, the inner acoustic tube 17 can be easily changed by forming screw threads on an inner side of the inner acoustic tube 17 and the pipe 3*a* fitting thereto. By using such embodiments, a distance between the front and rear acoustic terminals can be adjusted. Also, the length of the outer acoustic tube 16 and the inner acoustic tube 17 can be changeable, and adjustment of acoustic impedance (especially acoustic mass) becomes possible.

A method for fitting the outer acoustic tube 16 and the inner acoustic tube 17 is not limited to the above-described screw type fitting method. For example, a fitting method called bayonet-type and other type fitting method can be used.

As an example illustrated in FIG. 3, an arrangement position of the acoustic resistance material 18 is not limited to a tip of a microphone. An acoustic resistance material may be arranged in each of the outer acoustic tube 16 and the inner acoustic tube 17. Also, a felt material, spongy urethane, glass wool, and aluminum fiber can be used for an acoustic resistance material. In this manner, an acoustic resistance material can be arranged on a path of sound wave with a simple method. Therefore, directivity can be easily adjusted, and microphone characteristics corresponding to an installation site can be realized.

Furthermore, each opening of the outer acoustic tube 16 and the inner acoustic tube 17 may have a horn shape. A drive force of a diaphragm can be improved by including an acoustic tube having such a shape, and the acoustic tube can be used in a configuration including a microphone unit having high mechanical impedance. Examples of the microphone unit having high mechanical impedance includes a microphone unit of which diaphragm has high tension and a microphone unit of which acoustic impedance in the front and back of the diaphragm is high.

According to the above-described embodiment, in the doubled pipes provided on a front surface side of the unit, the rear acoustic terminal 32 is formed in an inner side of the pipe 3*a* having a small diameter, and the front acoustic terminal 31 is formed on an outer side thereof and an inner side of the pipe 2*b* having a large diameter. However, the condenser microphone unit according to the present invention is not limited to the embodiment.

Figure 4:
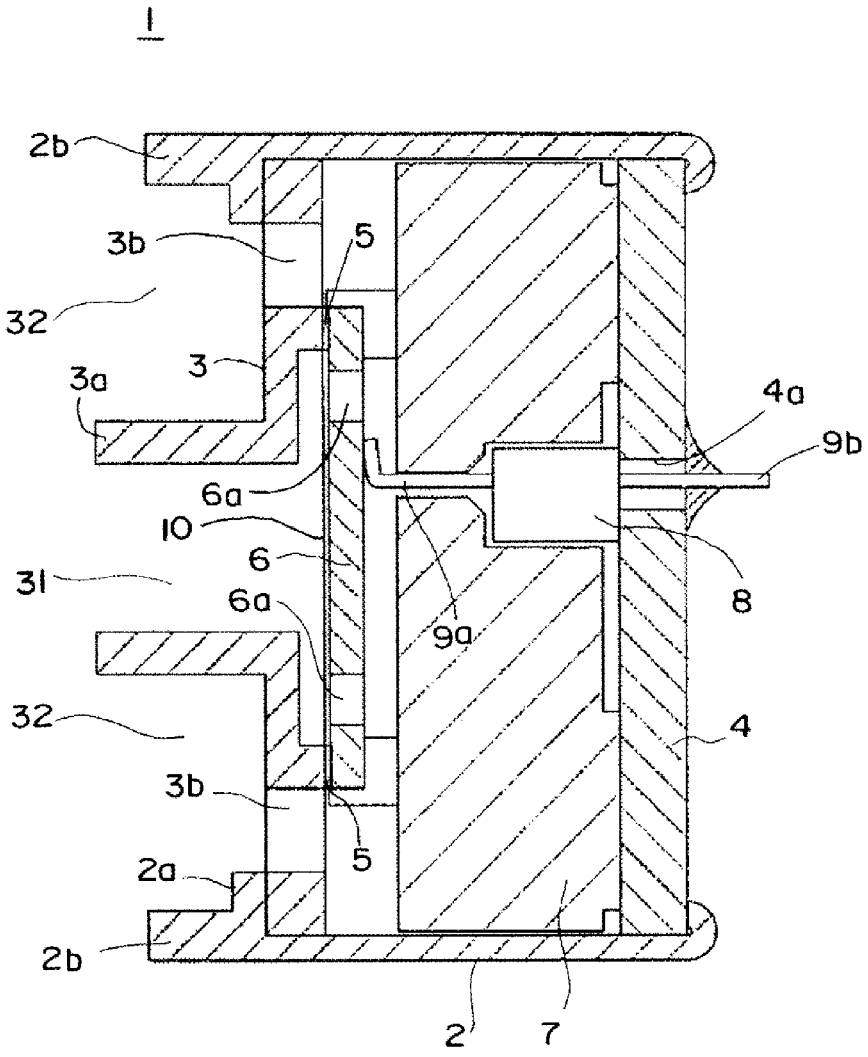
FIG. 4 is a cross-sectional view illustrating a variation of the condenser microphone unit according to the present invention.

For example, the front acoustic terminal 31 and the rear acoustic terminal 32 can be switched. Specifically, a configuration is as illustrated in FIG. 4. Embodiments of the fixed electrode 6 and the diaphragm 10 are significantly different between the configuration illustrated in FIG. 4 and the configuration illustrated in FIG. 1. Specifically, openings 6*b* and 10*a* are not provided at a center of the fixed electrode 6 and the diaphragm 10 illustrated in FIG. 4. Furthermore, the fixed electrode 6 and the diaphragm 10 have a small diameter so as to be arranged on the inner side than the sound hole 3*b* provided at the front lid 3. A predetermined space is formed between the fixed electrode 6 and the diaphragm 10 by adjusting a diameter of the ring-shaped spacer 5 to diameters of the fixed electrode 6 and the diaphragm 10.

By this configuration, sound wave passing through the pipe 3*a* arranged at a unit center applies sound pressure to a front surface side of the diaphragm 10, and sound wave passing through an inner side of the pipe 2*b* on an outer side of the pipe 3*a* goes around to a rear side of the fixed electrode 6 from the sound hole 3*b* and applies sound pressure to a back surface side of the diaphragm 10.

Specifically, an inner side of the pipe 3*a* having a small diameter becomes the front acoustic terminal 31, and an inner side of the pipe 2*b* having a large diameter and arranged on an outer side thereof becomes the rear acoustic terminal 32.

In the above-described configuration, an effect similar to that of the configuration illustrated in FIG. 1 can be obtained.

What is claimed is:

1. A condenser microphone unit, comprising:

a fixed electrode in which multiple sound holes are formed;

a diaphragm arranged with a predetermined space from the fixed electrode, the condenser microphone unit being a primary sound pressure-gradient type condenser microphone unit which drives the diaphragm by difference in sound pressure applied to front and back of the diaphragm, wherein the condenser microphone unit comprises a first pipe arranged on a front side of the diaphragm and extending forward, and a second pipe arranged so as to surround the first pipe, an opening corresponding to a position of the first pipe is formed to each of the diaphragm and the fixed electrode, an insulating pine formed of an insulating material is fitted to and inserted into the first pipe and the openings so that front and rear sides of the fixed electrode are acoustically separated, an inner side of the first pipe communicates with a rear side of the diaphragm, and a portion outside the first pipe and inside the second pipe communicates with the front side of the diaphragm.

2. The condenser microphone unit according to claim 1, wherein each of the first pipe and the second pipe is detachable.

3. The condenser microphone unit according to claim 1, wherein either one or both of an opening of the first pipe and an opening of the second pipe have a horn shape.

4. A condenser microphone unit, comprising:

a fixed electrode in which multiple sound holes are formed;

a diaphragm arranged with a predetermined space from the fixed electrode, the condenser microphone unit being a primary sound pressure-gradient type condenser microphone unit which drives the diaphragm by difference in sound pressure applied to front and back of the diaphragm, wherein the condenser microphone unit comprises a first pipe arranged on a front side of the diaphragm and extending forward, and a second pipe arranged so as to surround the first pipe, an inner side of the first pipe communicates with a front side of the diaphragm, a portion outside the first pipe and inside the second pipe communicates with a rear side of the diaphragm, the first pipe extending toward a front of the diaphragm only communicates with a front surface of the diaphragm, and diameters of the fixed electrode and the diaphragm are formed smaller than a diameter of the second pipe so that a communication path to a rear side of the fixed electrode is formed on an outer side of the first pipe and an inner side of the second pipe.

5. The condenser microphone unit according to claim 4, wherein each of the first pipe and the second pipe is detachable.

6. The condenser microphone unit according to claim 4, wherein either one or both of an opening of the first pipe and an opening of the second pipe have a horn shape.

7. A condenser microphone unit, comprising:

a fixed electrode in which multiple sound holes are formed;

a diaphragm arranged with a predetermined space from the fixed electrode, the condenser microphone unit being a primary sound pressure-gradient type condenser microphone unit which drives the diaphragm by difference in sound pressure applied to front and back of the diaphragm, wherein the condenser microphone unit comprises a first pipe arranged on a front side of the diaphragm and extending forward, and a second pine arranged so as to surround the first pipe, an inner side of the first pipe communicates with a rear side of the diaphragm, a portion outside the first pipe and inside the second pipe communicates with the front side of the diaphragm, and a front lid is arranged at the front side of the diaphragm and has the first pipe communicating with the rear side of the diaphragm, and a plurality of sound holes inside the front lid communicating with the front side of the diaphragm.

8. The condenser microphone unit according to claim 7, wherein each of the first pipe and the second pipe is detachable.

9. The condenser microphone unit according to claim 7, wherein either one or both of an opening of the first pipe and an opening of the second pipe have a horn shape.

10. A condenser microphone unit, comprising:

a fixed electrode in which multiple sound holes are formed;

a diaphragm arranged with a predetermined space from the fixed electrode, the condenser microphone unit being a primary sound pressure-gradient type condenser microphone unit which drives the diaphragm by difference in sound pressure applied to front and back of the diaphragm, wherein the condenser microphone unit comprises a first pipe arranged on a front side of the diaphragm and extending forward and a second pipe arranged so as to surround the first pipe, an inner side of the first pipe communicates with the front side of the diaphragm, a portion outside the first pipe and inside the second pipe communicates with a rear side of the diaphragm, and a front lid is arranged at the front side of the diaphragm and has the first pipe communicating with the front side of the diaphragm, and a plurality of sound holes inside the front lid communicating with the rear side of the diaphragm.

11. The condenser microphone unit according to claim 10, wherein each of the first pipe and the second pipe is detachable.

12. The condenser microphone unit according to claim 10, wherein either one or both of an opening of the first pipe and an opening of the second pipe have a horn shape.

13. A condenser microphone unit, comprising:

a fixed electrode in which multiple sound holes are formed; and a diaphragm arranged with a predetermined space from the fixed electrode, the condenser microphone unit being a primary sound pressure-gradient type condenser microphone unit which drives the diaphragm by difference in sound pressure applied to front and back of the diaphragm, wherein the condenser microphone unit comprises a first pipe arranged on a front side of the diaphragm and extending forward, and a second pipe arranged so as to surround the first pipe, a front acoustic terminal communicating with a front surface of the diaphragm is formed on an inner side of either one of the first pipe or the second pipe, a rear acoustic terminal communicating with a back surface of the diaphragm from a rear side of the fixed electrode is formed on an inner side of the other pipe, an opening corresponding to a position of the first pipe is formed to each of the diaphragm and the fixed electrode, an insulating pipe including an insulating material is fitted to and inserted into the first pipe and the opening, and front and rear sides of the fixed electrode are acoustically separated, the rear acoustic terminal is formed on an inner side of the first pipe, and the front acoustic terminal is formed on an outer side of the first pipe and on an inner side of the second pipe.

14. The condenser microphone unit according to claim 13, wherein each of the first pipe and the second pipe is detachable.

15. The condenser microphone unit according to claim 13, wherein either one or both of an opening of the first pipe and an opening of the second pipe have a horn shape.

* * * * *